US008130097B2

(12) United States Patent
Knust et al.

(10) Patent No.: US 8,130,097 B2
(45) Date of Patent: Mar. 6, 2012

(54) CARD AND CHIP DETECTION SYSTEM FOR A GAMING TABLE

(75) Inventors: Randy L. Knust, The Woodlands, TX (US); Eric Schoppe, Conroe, TX (US)

(73) Assignee: Genesis Gaming Solutions, Inc., Spring, TX (US)

( * ) Notice: Subject to any disclaimer, the term of this patent is extended or adjusted under 35 U.S.C. 154(b) by 351 days.

(21) Appl. No.: 12/270,476

(22) Filed: Nov. 13, 2008

(65) Prior Publication Data

US 2009/0121883 A1 May 14, 2009

Related U.S. Application Data

(60) Provisional application No. 60/987,570, filed on Nov. 13, 2007.

(51) Int. Cl.
*G08B 21/00* (2006.01)

(52) U.S. Cl. ..... 340/540; 340/641; 340/815.45

(58) Field of Classification Search ..... 340/540, 340/545.3, 641, 642, 323 R, 323 B, 332, 340/815.45
See application file for complete search history.

(56) References Cited

U.S. PATENT DOCUMENTS 4,378,114 A * 3/1983 Sargent ..... 473/24
4,531,187 A 7/1985 Uhland
5,451,054 A 9/1995 Orenstein
5,781,647 A 7/1998 Fishbine et al.
5,831,527 A * 11/1998 Jones et al. ..... 340/540
5,919,090 A 7/1999 Mothwurf
5,957,776 A 9/1999 Hoehne
6,059,659 A * 5/2000 Busch et al. ..... 463/17
6,267,671 B1 7/2001 Hogan
6,313,871 B1 * 11/2001 Schubert ..... 348/143
6,446,864 B1 9/2002 Kim et al.
6,460,848 B1 10/2002 Soltys et al.
6,567,159 B1 5/2003 Corech
6,848,994 B1 2/2005 Knust et al.
7,431,650 B2 10/2008 Kessman et al.
7,878,909 B2 2/2011 Kessman et al.
2001/0010025 A1 7/2001 Knust et al.
2002/0111213 A1 8/2002 McEntee et al.
2003/0003997 A1 1/2003 Vuong et al.
2005/0026684 A1 * 2/2005 Sumi et al. ..... 463/31
2005/0090310 A1 4/2005 Knust et al.
2005/0093241 A1 * 5/2005 Lipscomb et al. ..... 273/309
2005/0277463 A1 12/2005 Knust et al.

OTHER PUBLICATIONS

Parets, Robyn Taylor, "The newer Deal", International Gaming & Wagering Business, Apr. 1997, 2 pages.

* cited by examiner

*Primary Examiner* — Daniel Previl
(74) *Attorney, Agent, or Firm* — Winstead PC

(57) ABSTRACT

A card and detection system comprises a group of light sensors located under and covered over by a table felt. The light sensors are directed vertically upward to detect changes in light intensity on the top surfaces of the sensors through the felt. This allows flexibility of placement of the sensors and avoids daily maintenance issues. The sensors read through fabric to detect when objects such as chips or cards are placed on top of the felt. With this system, the procedure of detecting chips or cards is imperceptible to the customers or dealers.

14 Claims, 1 Drawing Sheet

CARD AND CHIP DETECTION SYSTEM FOR A GAMING TABLE

This application claims the benefit of U.S. Provisional Patent Application Ser. No. 60/987,570 filed Nov. 13, 2007.

FIELD OF THE INVENTION

The present invention relates generally to the field of gaming systems, and, more particularly, to system to detect a card or a chip placed on the surface of a gaming table.

BACKGROUND OF THE INVENTION

The card and chip detection system described herein is designed to detect if cards or chips are placed in a certain area on a gaming table. If the casino knows where and when chips or cards are on the table, then player tracking, dealer tracking, surveillance and pit management become very accurate. The casino will know an accurate count of how many total hands are dealt for providing free compensation ("comp") and occupancy purposes. Also, dealer audits are accurate for evaluating dealer efficiency and speed. Security knows immediately when and where hands are being played for video surveillance. Unknown patrons are automatically logged into the system for tracking purposes.

The current hand or chip detection devices are all positioned on the table on top of the table felt, such as a button or light sensor. This is very inefficient for maintenance reasons since every time a felt is changed the device must be disconnected and removed from the table. Damage is more likely from the device being exposed on the table top.

Functionality of such known systems is also inhibited since the table top space is limited. The sensors or buttons can only be mounted in certain areas as not to affect or delay the dealing or payout of the game directly.

SUMMARY OF THE INVENTION

In contrast, the system described herein is an improvement over current systems on the market today. The system comprises one light sensor or a group of light sensors located under the table felt. This allows complete flexibility of placement and avoids daily maintenance issues. The sensors are designed to read through fabric to detect when objects such as chips or cards are placed on top of the felt. With this system, the procedure of detecting chips or cards is imperceptible to the customers or dealers.

To accomplish the goal of developing a commercial application, a system of electronic computer hardware and software were developed that first detects an object placed on a gaming table. This is accomplished by a light sensor that can detect changes in light through fabrics with changing ambient lighting conditions. These sensors detect where and when an object is set on the table and relays that information back to a central computing unit.

Further, the system sends data from the sensors into the main pit computer. To accomplish this, computer boards accept data from the sensors. These boards have wireless transmission capabilities from any gaming table to one central computer for identification and processing. This can also be accomplished by putting a PC or thin client computer under each table.

Finally, the system stores data into a player tracking database program for viewing and analysis. The program is preferably written in Visual Studio using a SQL Server database for storage, or other existing or later developed system.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
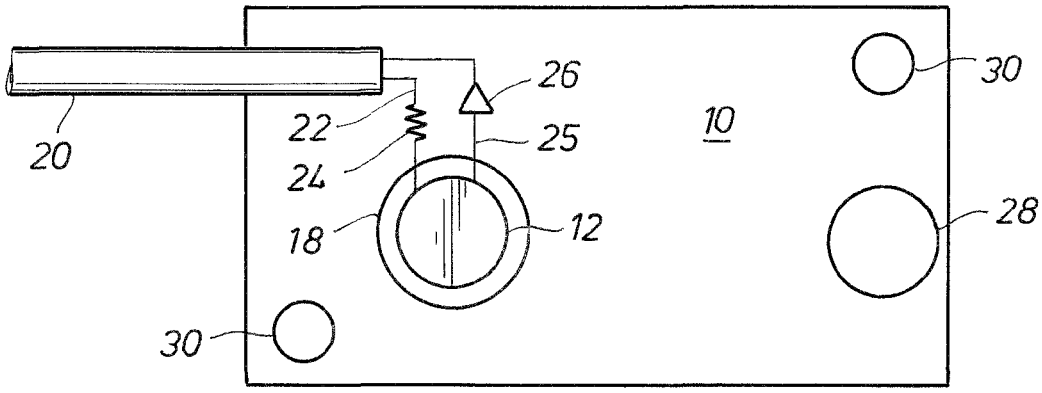
FIG. 1 is a plan schematic diagram of a chip or card detection system.

FIG. 1 illustrates a charge coupled device (CCD) light sensor board 10, in accordance with the teachings of the present invention. One such light sensor board 10 is associated with each player position around a gaming table, as shown and described below in greater detail. The CCD light sensor board 10 generally comprises a cadmium sulphide sensor 12 whose resistance changes in response to light, as powered from a cable 20 through a conductor 22. The light sensor 12 pulls against a resistance 24 to create a changing voltage point, in a manner known in the art. This changing voltage point is measured using an Analog to Digital (A/D) converter 26 through a conductor 25 and calibrated continuously to detect changes in light through fabrics and changing lighting conditions. The light sensor board 10 also contains a light-emitting diode 28 which serves as a location indicator and is optically isolated from the light sensor. The entire light sensor board assembly is preferably mounted to a gaming table beneath the table-covering felt with a set of mounting holes 30.

Figure 2:
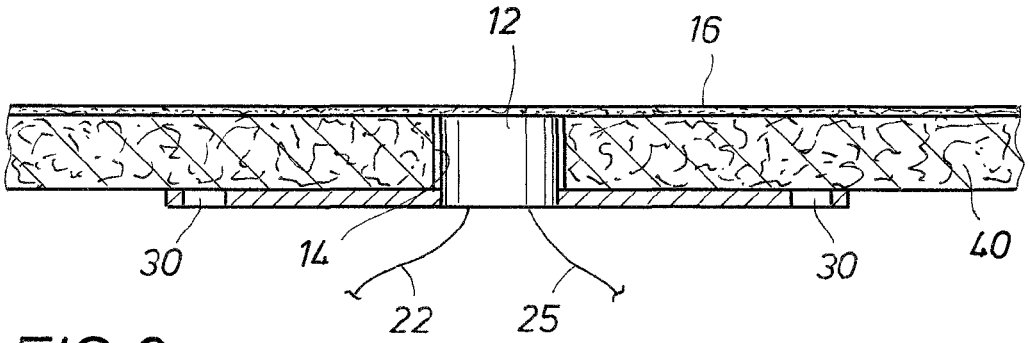
FIG. 2 is a side section view through a table top illustrating the light sensor sensing change in light energy transmitted through a table top felt on a gaming table.

A shown in FIGS. 1 and 2, a tabletop 40 includes a light sensor 12 mounted in a hole 14 in the tabletop. The light sensor 12 is mounted in such a way that it is substantially flush with the top surface of the tabletop. A felt layer 16 is installed over the tabletop over the light sensor. The light sensor senses changes in light entering the light sensor through the felt. When a new felt is installed, a registration pattern 18 FIG. 1), which is printed on the felt, is installed over the light sensor. So, when a chip or a card is placed over the sensor, or even if it just passes over the sensor, the sensor detects the change in ambient light and informs the data collection system.

Figure 3:
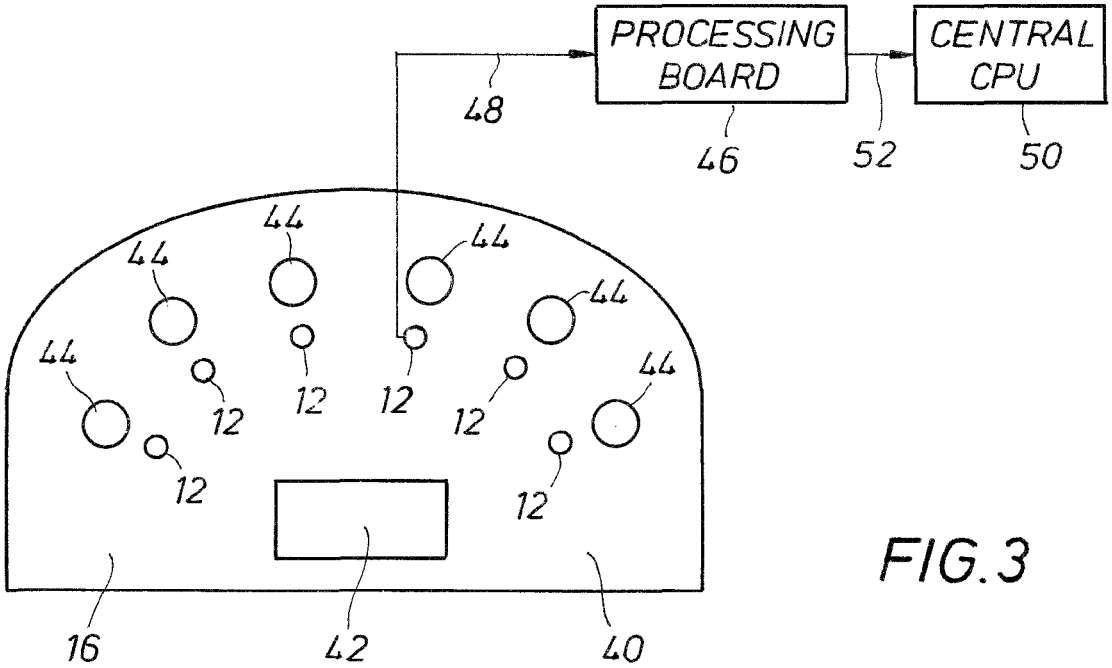
FIG. 3 is a schematic view of a data transmission portion of the system.

FIG. 3 illustrates one preferred embodiment of a reporting system using the card and chip detection system of FIGS. 1 and 2. The tabletop 40 is covered with a felt layer 16, as previously described. A dealer's position 42 is positioned along one location beside the gaming table, while a plurality of player positions 44 are arrayed in a semi-circle along the side of the table. A sensor 12 is positioned adjacent each player position.

Each of the sensors 12 is coupled electronically with a processing board 46 through a connection 48. The processing board 46 is electronically coupled to a central processing unit (CPU) 50, preferably wirelessly, through a connection 52. Preferably, each of the sensors is monitored continuously, so that any alteration in the state of the A/D converter 26 (FIG. 1) associated with any sensor will be sensed by the processing board 46 and transmitted to the CPU and stored. This allows the proprietor to maintain an up to the minute determination of the gaming at each player position through out the establishment, such as for example in a casino.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A card and chip detection system for a gaming table, the system comprising:

a. a plurality of light sensors positioned vertically to detect light intensity on an upper surface of each of the light sensors;

b. a felt fabric covering the plurality of light sensors; and c. an electronic system coupling the plurality of light sensors to detect a change in light intensity at any of the plurality of light sensors.

2. The system of claim 1, further comprising a table top defining an upper surface covered by the felt fabric.

3. The system of claim 2, wherein each of the plurality of light sensors is flush with the upper surface of the table top.

4. The system of claim 1, further comprising an analog to digital converter coupled to each of the light sensors.

5. The system of claim 4, further comprising a processing board electronically coupled to the analog to digital converters.

6. The system of claim 5, wherein the processing board is adapted to detect a change in state from any of the analog to digital converters and to develop a digital signal indicative of a change in state of any of the analog to digital converters.

7. The system of claim 6, further comprising a central processing unit adapted to receive the signal from the processing board.

8. The system of claim 2, wherein the plurality of light sensors are positioned adjacent to a plurality of player positions along the table top.

9. The system of claim 7, wherein, for each light sensor in the plurality of light sensors:

the analog to digital converter is operable to detect a change in light intensity through the felt fabric as an object passes over the light sensor; and the detected change in light intensity comprises a change in state.

10. The system of claim 9, wherein the central processing unit is operable to store information related to a change in state via the received signal.

11. The system of claim 10, wherein, for each light sensor in the plurality of light sensors, the processing board is operable to continuously monitor the analog to digital converter for changes in state.

12. The system of claim 9, wherein the object comprises at least one of a chip and a card.

13. A card and chip detection system for a gaming table, the system comprising:

a plurality of light sensors positioned vertically to detect light intensity on an upper surface of each of the light sensors;

a felt fabric covering the plurality of light sensors;

an electronic system coupling the plurality of light sensors wherein, for each light sensor in the plurality of light sensors, the electronic system is operable to:

detect a change in light intensity through the felt fabric as an object is placed over the light sensor, the detected change comprising a change in state; and continuously monitor the light sensors for changes in state.

14. A card and chip detection system for a gaming table, the system comprising:

a plurality of light sensors positioned vertically to detect light intensity on an upper surface of each of the light sensors;

an analog to digital converter coupled to each of the plurality of light sensors;

a processing board electronically coupled to the analog to digital converters;

a felt fabric covering the plurality of light sensors;

an electronic system coupling the plurality of light sensors to detect a change in light intensity at any of the plurality of light sensors;

wherein, for each light sensor in the plurality of light sensors:

the analog to digital converter is operable to detect a change in light intensity through the felt fabric as at least one of a chip or a card passes over the light sensor; and the detected change in light intensity comprises a change in state; and wherein, for each light sensor in the plurality of light sensors, the processing board is operable to monitor the analog to digital converter for changes in state.

* * * * *